US006409044B1

(12) United States Patent
Brown et al.

(10) Patent No.: US 6,409,044 B1
(45) Date of Patent: Jun. 25, 2002

(54) DISPENSING ORIFICE

(75) Inventors: Jeffrey Brown, Ramsey; Cathy Durden, Midland Park; Dane R Jackson, Bloomingdale, all of NJ (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/538,811

(22) Filed: Mar. 30, 2000

(51) Int. Cl.[7] ..... B65H 5/28
(52) U.S. Cl. ..... 221/63; 206/812
(58) Field of Search ..... 221/33, 45, 46, 221/63, 48; 206/449, 494, 812

(56) References Cited

U.S. PATENT DOCUMENTS

| | | | | |
|---|---|---|---|---|
| 1,919,605 A | | 7/1933 | Swallow | |
| D96,471 S | | 8/1935 | Horwitt | |
| 2,433,587 A | | 12/1947 | Wentworth | 312/50 |
| D158,485 S | | 5/1950 | Manetti | D52/2 |
| D159,753 S | | 8/1950 | Pelton | D58/2 |
| D167,890 S | | 10/1952 | Hallward | D4/3 |
| 2,640,587 A | | 6/1953 | Smith | 206/37 |
| 2,689,059 A | | 9/1954 | Nudell | 220/41 |
| 2,826,230 A | | 3/1958 | Conell | 150/52 |
| D182,410 S | | 4/1958 | Gemora | D4/3 |
| D184,218 S | | 1/1959 | Fishman | D52/2 |
| 3,002,668 A | | 10/1961 | Castelli | 225/52 |
| 3,207,360 A | | 9/1965 | Scott | 221/48 |
| 3,207,361 A | | 9/1965 | Marcalus | 221/48 |
| D203,869 S | | 2/1966 | Poris | D52/2 |
| 3,235,196 A | | 2/1966 | Platt | 242/55.53 |
| 3,269,593 A | | 8/1966 | Lodewick et al. | 221/63 |
| 3,395,830 A | | 8/1968 | Buttery | 221/63 |
| 3,982,659 A | | 9/1976 | Ross | 221/63 |
| D254,898 S | | 5/1980 | Buerk | D9/259 |
| 4,678,099 A | | 7/1987 | Matsui | 221/48 |
| 4,735,317 A | | 4/1988 | Sussman et al. | 206/449 |
| 4,848,575 A | | 7/1989 | Nakamura et al. | 206/449 |
| 5,137,173 A | | 8/1992 | Hughes et al. | 221/34 |
| 5,219,421 A | | 6/1993 | Tipping | 221/63 |
| RE34,324 E | | 7/1993 | Haenni et al. | 225/106 |
| D337,227 S | | 7/1993 | Giugiaro | D6/518 |
| 5,542,567 A | * | 8/1996 | Julius | 221/63 |
| 5,542,568 A | | 8/1996 | Julius | 221/63 |
| 5,613,608 A | | 3/1997 | Tronchetti et al. | 206/494 |
| 5,699,912 A | | 12/1997 | Ishikawa et al. | 206/494 |
| 5,704,471 A | | 1/1998 | Yamada | 206/207 |
| 5,729,955 A | | 3/1998 | Yamada | 53/412 |
| 6,053,357 A | | 4/2000 | Yoh | 221/63 |

FOREIGN PATENT DOCUMENTS

| | | |
|---|---|---|
| AU | 077021944 A | 8/1978 |
| DE | 25 42 038 | 4/1976 |
| EP | 0 006 709 A1 | 1/1980 |
| JP | 2-265479 | 9/1989 |
| JP | 6-263174 | 9/1994 |
| NL | 7900371 | 7/1980 |

* cited by examiner

*Primary Examiner*—Kenneth W. Noland
(74) *Attorney, Agent, or Firm*—Ohlandt, Greeley, Ruggiero & Perle,LLP

(57) ABSTRACT

There is provided a dispensing orifice. The edge surfaces of the orifice define a breadth and a width for the orifice. The ratio of the minimum breadth of the orifice to the thickness of a dispensed sheet is preferably about 8:1 to about 18:1. The ratio of the width of a dispensed sheet to the maximum width of the orifice is preferably about 2:1 to about 5:1. In a preferred embodiment, at least one of the sides of the orifice is curved. Moreover, at least one of the sides of the orifice preferably has a plurality of nodules extending a distance into the orifice. Preferably, the ratio of the minimum breadth of the orifice to the distance that the nodules extend into the orifice is about 2:1 to about 8:1.

19 Claims, 3 Drawing Sheets

DISPENSING ORIFICE

BACKGROUND OF THE INVENTION

1. Field of the Invention

The present invention relates to a container that dispenses pre-moistened sheets. More particularly, the present invention relates to a container having an orifice for dispensing one pre-moistened sheet at a time from a stack or roll of sheets.

2. Description of the Prior Art

There are containers presently available for the purpose of dispensing or emitting a pre-moistened sheet, towelette, or wipe from either a continuous roll or a separately folded stack of sheets.

Pre-moistened sheets, towelettes, or wipes are typically packaged in one of two types of containers, namely a canister or a box. In the canister, the sheets are wound into a continuous roll and perforated to facilitate separation of each sheet from the roll. Sheets are removed from the canister through a dispensing orifice. In the box, the sheets are individually folded and stacked on top of each other. Each sheet is dispensed by opening the lid of the box, reaching in, and removing the top sheet from the stack.

There are inherent problems with both of these types of packages. With the canister, the force needed to separate a sheet from the roll is such that the act of dispensing a sheet is a two-hand operation, one hand to hold the canister, and one hand to pull out the sheet. With the box, a person can reach in with one hand and grab a sheet, but several sheets are often withdrawn at a time because the moisture in the sheets makes the sheets stick together. It is also difficult to find the leading edge of the top sheet.

In an attempt to resolve these dispensing problems, there have been some recent changes to both container designs and the way that the sheets are folded. One design still has the sheets perforated, but they are folded instead of being wound into a roll. The perforations on these wipes are somewhat easier to break than on a canister type package, so that the wipes can generally be dispensed with one hand.

A further improvement is interfolding of the sheets. Interfolding has been used for many years on dry products such as facial tissues. Now, it is being used with moist sheets. Interfolded sheets are easier to dispense than perforated sheets because interfolded sheets lack perforations. However, there are still problems associated with interfolded sheets. Often, such wipes do not dispense one at a time, especially at the bottom of a stack of pre-moistened sheets where each sheet holds more moisture.

Many dispensing problems for interfolded sheets can be attributed to the dispensing orifice. Generally, the dispensing orifices that are commercially available for interfolded sheets have high failure rates. One of the most common problems associated with these orifices is a phenomenon called "roping", wherein more than one sheet is dispensed through the orifice at a time. The number of sheets improperly dispensed per roping incident typically ranges from two to ten. However, the number of improperly dispensed sheets can be much higher depending on the orifice configuration. For example, tests show that a dispensing container with a common Y-shaped orifice will have an average of about ten roping incidents before the container is empty. On average, about ten sheets are improperly dispensed per roping incident. The common H-shaped orifice arguably performs a little better, since it improperly dispenses, on average, about three sheets per roping incident. However, the common H-shaped orifice has an average of about thirteen roping incidents.

Clearly, there is a need for an improved dispensing orifice for pre-moistened, folded sheets, whose orifice prevents roping.

SUMMARY OF THE INVENTION

It is the object of the present invention to provide a dispensing container for pre-moistened sheets.

It is another object of the present invention to provide such a dispensing container with a dispensing orifice that minimizes improper dispensing of pre-moistened sheets.

These and other objects of the present invention are achieved by a dispensing orifice as described herein. The edge surfaces of the orifice define a breadth and a width for the orifice. The ratio of the minimum breadth of the orifice to the thickness of a dispensed sheet is preferably about 8:1 to about 18:1. The ratio of the width of a dispensed sheet to the maximum width of the orifice is preferably about 2:1 to about 5:1. In a preferred embodiment, at least one side of the orifice is curved. Moreover, at least one of the sides of the orifice preferably has a plurality of nodules extending a distance into the orifice. If there are nodules, the ratio of the minimum breadth of the orifice to the distance that the nodules extend into the orifice is preferably about 2:1 to about 8:1.

DETAILED DESCRIPTION OF THE INVENTION

Figure 1:
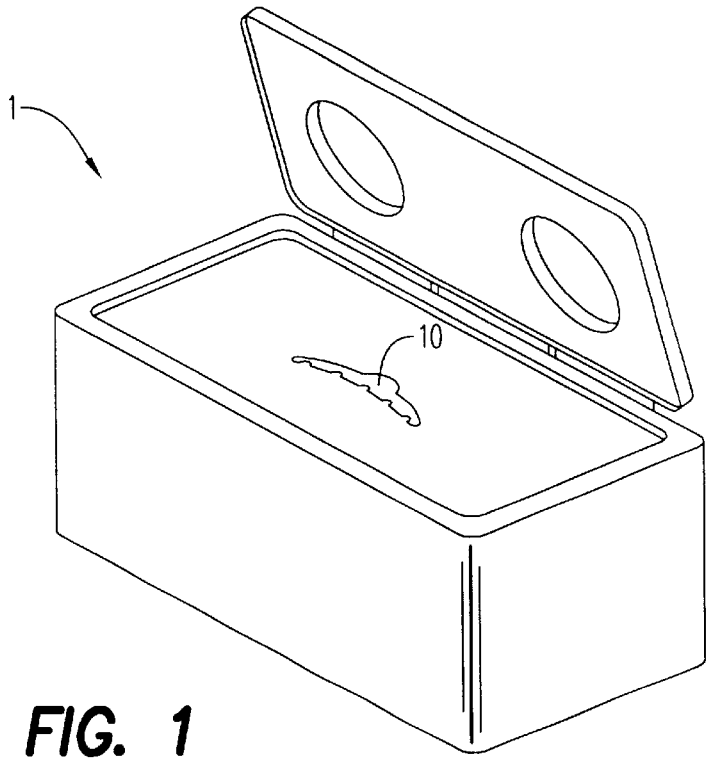
FIG. 1 is a perspective view of a dispensing container with a dispensing orifice according to the present invention.
Figure 2:
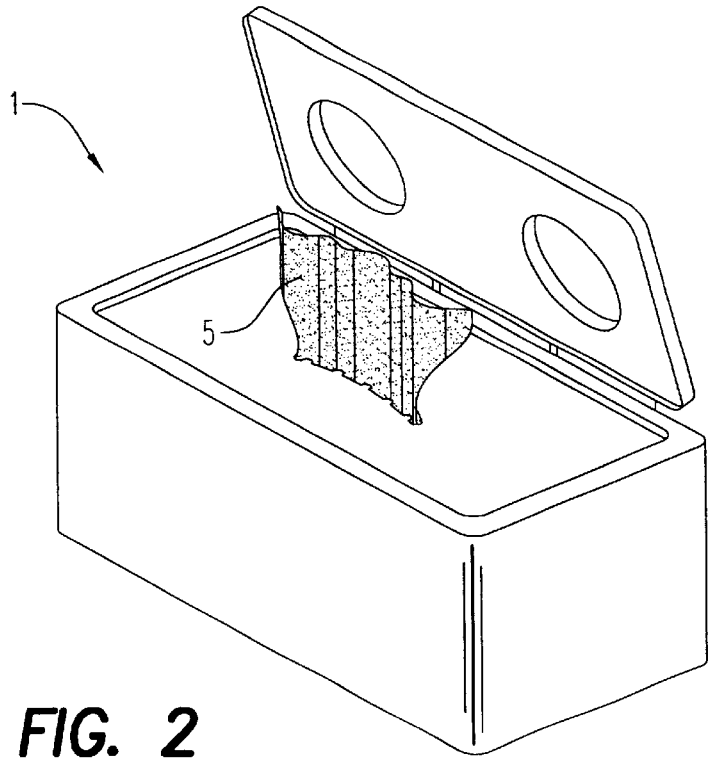
FIG. 2 is a perspective view of the dispensing container of FIG. 1 with a sheet being dispensed through the orifice.

Referring to the drawings and, in particular, FIG. 1, there is provided a dispensing container generally represented by reference numeral 1. Dispensing container 1 generally may have any shape. However, dispensing container 1 typically has a box shape as shown, or a tubular shape (not shown). In one side or portion of container 1, there is a dispensing orifice 10 adapted to emit a sheet 5 shown in FIG. 2. Sheet 5 is preferably a pre-moistened towelette, wipe, or sheet.

Each preferred configuration of orifice 10 is designed to separate a first emitted sheet from the remaining sheets in container 1 as the sheet is pulled therethrough. Thus, container 1 emits only one sheet at a time.

Figure 3:
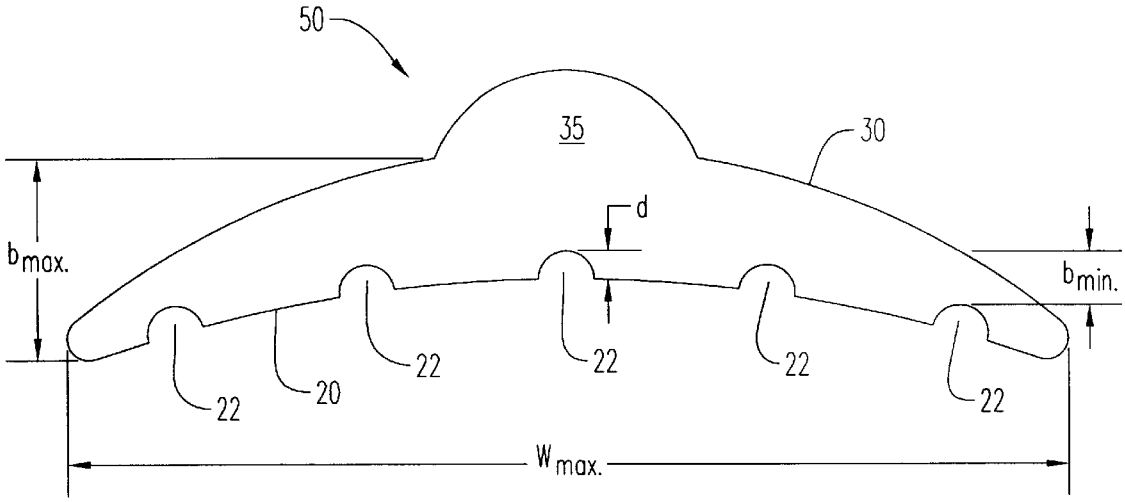
FIG. 3 is a plan view of the orifice of FIG. 1.

Referring to FIG. 3, there is illustrated an orifice 50 according to the present invention. Orifice 50 has a first surface or side 20 that is spaced from a second surface or side 30, so that a sheet can pass therebetween. The largest distance between first side 20 and second side 30 is the maximum breadth of dispensing orifice 50, generally represented as $b_{max.}$ The smallest distance between first side 20 and second side 30 is the minimum breadth of dispensing orifice 50, generally represented as $b_{min.}$. Sides 20, 30 also define the maximum width of dispensing orifice 10, which is generally represented as $w_{max.}$.

A sheet emitted through orifice 50 has a sheet thickness and a sheet width. The sheet thickness corresponds to the breadth of orifice 50, while the sheet width corresponds to the width of orifice 50. Thus, the thickness of a sheet emitted through orifice 50 is measured along the same axis as the breadth of orifice 50. The width of a sheet emitted through orifice 50 is measured along the same axis as the width of orifice 50. For orifice 50, maximum width $w_{max.}$ is perpendicular to maximum and minimum breadth $b_{max.}$ and $b_{min.}$. For a sheet emitted through orifice 50, sheet width is perpendicular to sheet thickness.

In the embodiment shown in FIG. 3, both first side 20 and second side 30 are curvilinear so as to create an arcuately shaped orifice. Moreover, second side 30 may have a semi-circular notch 35. The notch 35 allows a user to easily feed a sheet through orifice 50.

It has been found that only one sheet is dispensed through orifice 50 at a time. This is apparently due to the ratio of the minimum breadth $b_{min.}$ of orifice 50 to the thickness of the sheets dispensed from orifice 50. Also, it is apparently owing to the ratio of maximum width $W_{max.}$ of orifice 50 to the width of the sheets dispensed from orifice 50.

Side 20 may have one or more nodules 22 that extend a distance d into $b_{max.}$ Nodules 22 may be in the form of protuberances, tongues, or projections. If there are nodules 22, the distance between nodule 22 and side 30 defines minimum breadth $b_{min.}$. The ratio of $b_{min.}$ to distance d is preferably about 2:1 to about 8:1 and, more preferably, about 2:1 to about 4:1. Preferably, there are between two and five nodules 22. More preferably, there are five nodules 22 on side 20. Optionally, second side 30 may also have one or more nodules (not shown).

Figure 4:
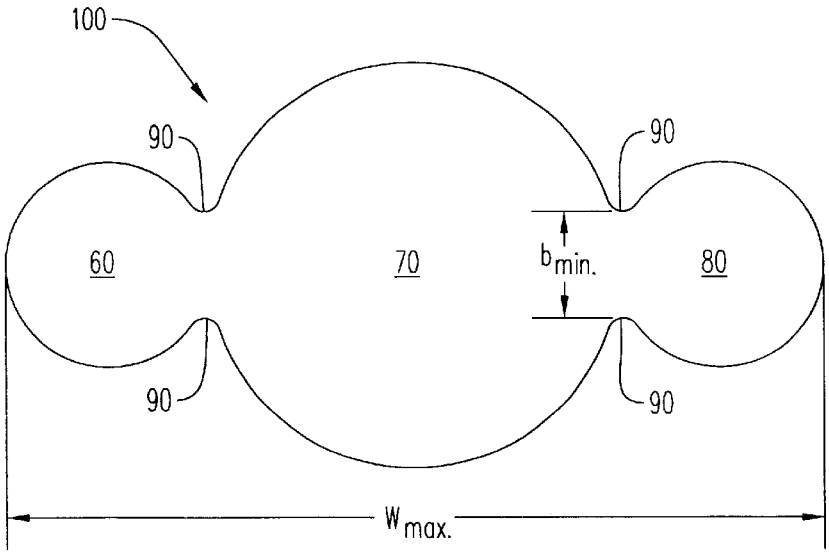
FIG. 4 is a plan view of a second embodiment of a dispensing orifice according to the present invention.

FIG. 4 illustrates a dispensing orifice 100 according to the present invention. The dispensing orifice 100 is basically three, hollow, circular areas 60, 70 and 80. Area 70 is positioned between circular areas 60 and 80. The maximum width $w_{max.}$ of orifice 100 is the sum of the contiguous diameters of circular areas 60, 70, and 80. As illustrated, circular area 70 is the largest diameter circular area. However, the circular areas may be any diameter so long as areas 60 and 80 arcuately contact area 70, thereby forming two opposed pairs of nodules 90 at opposite sides of circular area 70. The distance between each opposed pair of nodules 90 defines the minimum breadth $b_{min.}$ of orifice 100. The minimum breadth $b_{min.}$ is related to the thickness of the sheet dispensed through dispensing orifice 100, while the maximum width $w_{max.}$ is related to the width of the sheet, such that only one sheet is able to pass through orifice 100 at a time.

Figure 5:
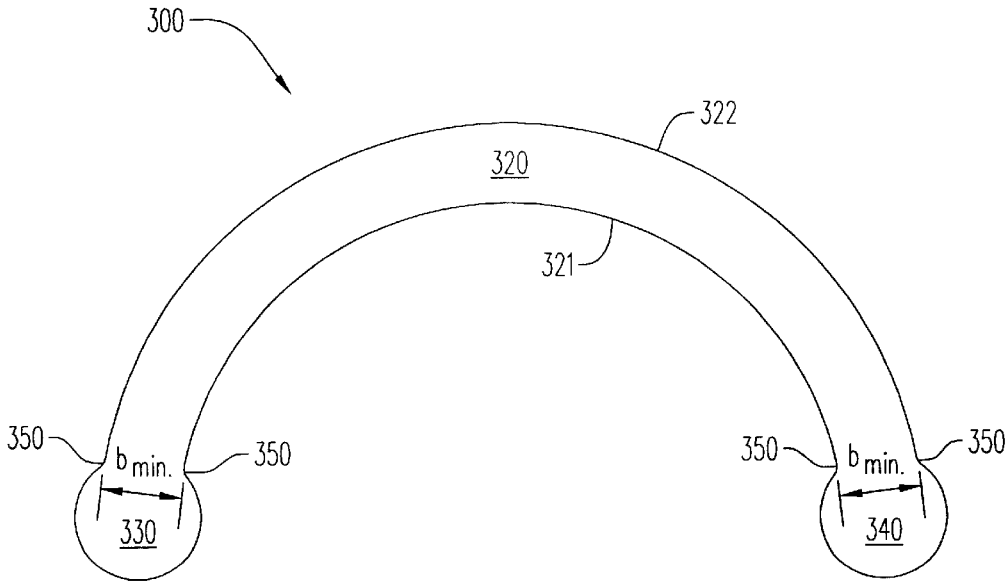
FIG. 5 is a plan view of a third embodiment of a dispensing orifice according to the present invention.

FIG. 5 illustrates a dispensing orifice 300 according to the present invention. Dispensing orifice 300 has an oblong, arcuate center portion 320 and a pair of circular-shaped end portions 330, 340. The center portion 320 preferably has a pronounced arc, so that it is almost a semi-circle. Sides 321 and 322 define the maximum width $w_{max.}$ of orifice 300.

Each end portion 330, 340 contacts center portion 320 to form two opposed pairs of shoulders 350. The distance the apex or top of the arc of shoulder 350 defines a minimum breadth $b_{min.}$ of orifice 300. The top sheet of a stack or roll of sheets will be emitted by orifice 300. Yet, the next or following sheet will not fully emit, as expected.

Figure 6:
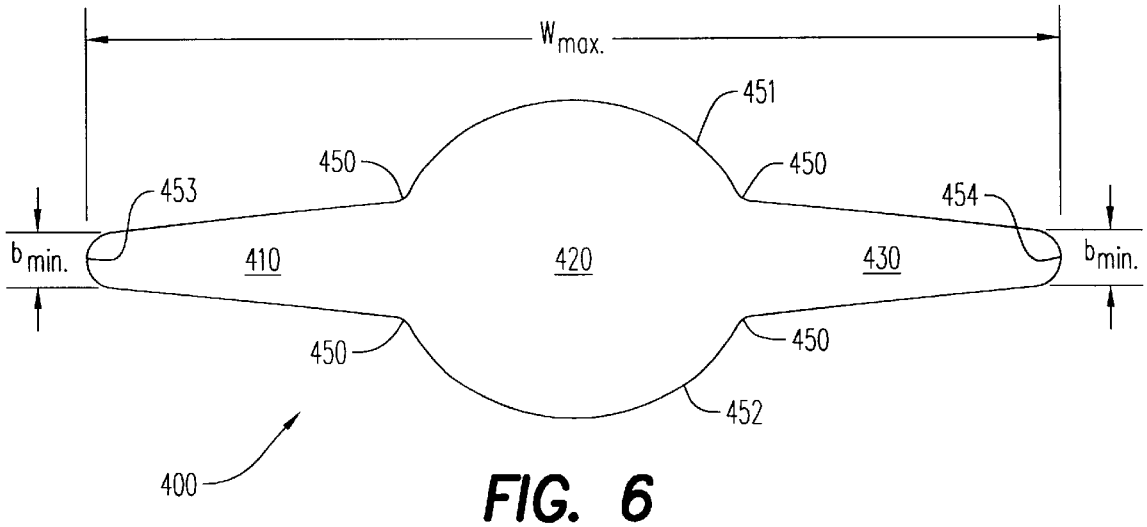
FIG. 6 is a plan view of a fourth embodiment of a dispensing orifice according to the present invention.

FIG. 6 illustrates dispensing orifice 400 according to the present invention. Dispensing orifice 400 has a hollow, oval-shaped center portion 420 and a pair of outwardly extending oblong portions 410, 430. Portions 410, 420, and 430 are defined by a pair of opposed longitudinal sides 451, 452 and a pair of opposed lateral sides 453, 454. Like dispensing orifice 300, center portion 420 meets each oblong portion 410, 430 to form a pair of shoulders 450 at each juncture point or surface, thereby defining the minimum breadth $b_{min.}$ of orifice 400. The distance between sides 453 and 454 defines the maximum width $w_{max.}$. The dimensions of orifice 400 are such that the inner surfaces of orifice 400, including shoulders 410, 430, are designed to contact a first sheet.

According to the present invention, the minimum breadth $b_{min.}$ is related to the thickness of sheet 5, while the maximum width $w_{max.}$ of orifice 10 is related to the width of sheet 5, which is dispensed therethrough. The dimensions of the preferred configurations of dispensing orifice 10 conform to two ratios. First, the ratio of $b_{min.}$ to the thickness of a sheet to be dispensed is about 8:1 to about 18:1 and, more preferably, about 10:1 to about 17:1. This ratio must be maintained in order to practice any preferred embodiment of the present invention. Second, the ratio of sheet width to maximum width $w_{max.}$ is about 2:1 to about 5:1 and, more preferably, about 2.9:1 to about 3.6:1. This ratio should be followed in any preferred embodiment of the present invention. Furthermore, in all embodiments of the orifice according to the present invention, at least one surface or side has a curvilinear feature or structure. Thus, the shape of the orifice can vary widely as long as the foregoing described ratio of $b_{min.}$ to the thickness of the sheet is maintained and there is at least one surface or side of the orifice has at least one curvilinear feature or structure.

Chart A summarizes the results of dispensing studies in which its minimum breadth $b_{min.}$ was varied according to sheet thickness. This chart shows that the size of the orifice is related to performance, since less roping occurred when thinner sheets were emitted from an orifice having a smaller $b_{min.}$. In addition, when roping occurred, fewer sheets were improperly dispensed when thinner sheets dispensed through narrower orifices. Similar observations were noted when thicker sheets were dispensed through a larger $b_{min.}$, as shown in Chart B.

For Charts A and B, sheet thickness is measured in inches using a 0.5" diameter pressure foot, 577 g/in$^2$ pressure, and a 3 second dwell time.

CHART A

Roping and Improper Dispensing of Towelettes having a Sheet Thickness of .012" to .013"

| Dispensing Orifice No. (FIG. No.) | Average Number of Incidents of Roping per Container | Average Number of Sheets Improperly Dispensed per Container | Narrowest Breadth of Orifice ($b_{min.}$) in Inches |
|---|---|---|---|
| 1 (FIG. 3) | 9.5 | 22.8 | 0.250 |
| 2 (FIG. 3) | 1.2 | 2.4 | 0.125 |
| 3 (FIG. 4) | 12.1 | 34.2 | 0.250 |
| 4 (FIG. 4) | 4.3 | 6.0 | 0.125 |
| 5 (FIG. 5) | 11.0 | 26.2 | 0.250 |
| 6 (FIG. 5) | 3.6 | 7.7 | 0.125 |
| 7 (FIG. 6) | 6.6 | 25.2 | 0.250 |
| 8 (FIG. 6) | 2.5 | 6.0 | 0.125 |

CHART B

Roping and Improper Dispensing of Towelettes having a Sheet Thickness of .014" to .015"

| Dispensing Orifice No. | Average Number of Incidents of Roping per Container | Average Number of Sheets Improperly Dispensed per Container | Narrowest Breadth of Orifice ($b_{min.}$) in Inches |
|---|---|---|---|
| 1 | 0 | 0 | 0.250 |
| 3 | 0 | 0 | 0.250 |
| 5 | 0 | 0 | 0.250 |
| 7 | 0 | 0 | 0.250 |

The present invention having been thus described with particular reference to the preferred form thereof, it will be understood that various changes and modifications may be made therein without departing from the spirit and scope of the invention as defined in the appended claims.

Wherefore we claim:

1. An orifice for dispensing a sheet having a thickness, said orifice having a minimum breadth, wherein the ratio of said minimum breadth of said orifice to said thickness of said sheet is about 8:1 to about 18:1.

2. The orifice according to claim 1, wherein said ratio is about 10:1 to about 17:1.

3. An orifice for dispensing a sheet, said orifice having at least one pair of opposing sides that define a maximum breadth for said orifice, wherein at least one of said pair of opposing sides has one or more nodules that extend a distance into said maximum breadth and thereby define a minimum breadth for said orifice, whereby the ratio of said minimum breadth to said distance is about 2:1 to about 8:1.

4. The orifice according to claim 3, wherein the ratio of said minimum breadth to said distance is about 2:1 to about 4:1.

5. The orifice according to claim 3, wherein said orifice has 2 to 5 nodules extending into said maximum breadth.

6. The orifice according to claim 5, wherein said orifice has 5 nodules extending into said maximum breadth.

7. An orifice for dispensing a sheet having a width, said orifice having a maximum width and at least one pair of opposing sides that define a maximum breadth, wherein at least one of said pair of opposing sides has one or more nodules that extend a distance into said maximum breadth and thereby define a minimum breadth for said orifice and the ratio of said width of said sheet to said maximum width of said orifice is about 2:1 to about 5:1.

8. The orifice according to claim 7, wherein said ratio is about 2.9:1 to about 3.6:1.

9. A container for dispensing a plurality of pre-moistened sheets, each sheet having a thickness and a width, wherein said container has an orifice through which each pre-moistened sheet is emitted, said orifice having a plurality of edge surfaces that define a maximum breadth and a maximum width for said orifice, said orifice having one or more nodules extending a distance into said maximum breadth from at least one of said edge surfaces, said nodules defining a minimum breadth for said orifice, whereby the ratio of said minimum breadth to said thickness of each sheet is about 8:1 to about 18:1, and whereby the ratio of width of said sheet to said maximum width of said orifice is about 2:1 to about 5:1.

10. The container according to claim 9, wherein the ratio of said minimum breadth to said thickness is about 2.9:1 to about 3.6:1.

11. The container according to claim 9, wherein the ratio of said width of said sheet to said maximum width of said orifice is about 10:1 to about 17:1.

12. The container according to claim 9, wherein the ratio of said minimum breadth to said distance that said nodules extend into said maximum breadth is about 2:1 to about 8:1.

13. The container according to claim 12, wherein the ratio of said minimum breadth to said distance is about 2:1 to about 4:1.

14. The container according to claim 9, wherein said orifice has two to five nodules.

15. The container according to claim 9, wherein said orifice has five nodules.

16. The container of claim 9, wherein said orifice is curvilinear.

17. The container of claim 16, wherein said orifice is arcuately shaped.

18. The container of claim 16, wherein said orifice has a plurality of substantially circular-shaped regions.

19. The container of claim 16, wherein said orifice has a substantially circular-shaped center region and a plurality of substantially oblong end regions.

* * * * *